US006371315B1

(12) United States Patent
Chien

(10) Patent No.: US 6,371,315 B1
(45) Date of Patent: Apr. 16, 2002

(54) NURSING BOTTLE WITH A TEAT

(76) Inventor: Pei-Chang Chien, 10F, No. 462-9, Fu Hsing Road, Taoyuan City, Taoyuan Hsien (TW)

( * ) Notice: Subject to any disclaimer, the term of this patent is extended or adjusted under 35 U.S.C. 154(b) by 0 days.

(21) Appl. No.: 09/638,246

(22) Filed: Aug. 14, 2000

(30) Foreign Application Priority Data

Aug. 16, 1999 (TW) ..... 088213842

(51) Int. Cl.[7] ..... A61G 9/04

(52) U.S. Cl. ..... 215/11.5; 215/11.1; 215/310; 606/234

(58) Field of Search ..... 215/11.5, 11.1–11.6, 215/351, 346, 344, 310, 307; D24/193, 196, 197; 606/234, 235, 236

(56) References Cited

U.S. PATENT DOCUMENTS 2,616,581 A * 11/1952 Madsen et al. ..... 215/11.5
4,940,152 A * 7/1990 Lin ..... 215/11.5
5,060,811 A * 10/1991 Fox ..... 215/6

* cited by examiner

*Primary Examiner*—Allan N. Shoap
*Assistant Examiner*—Lien Ngo
(74) *Attorney, Agent, or Firm*—Ostrolenk, Faber, Gerb & Soffen, LLP

(57) ABSTRACT

A nursing bottle with a teat and a rim is able to allow the baby to suck the liquid within the nursing bottle easily and the flow of the liquid will not be blocked at any circumstances. The teat has a hole defined in the first flange thereof. The rim has multiple apertures defined to correspond to the hole of the teat and communicate with the ambient air. After the combination of the teat and the rim, the ambient air communicates with the air inside the nursing bottle, such that liquid within the nursing bottle is able to be sucked out of the nursing bottle easily by the body.

1 Claim, 4 Drawing Sheets

NURSING BOTTLE WITH A TEAT

BACKGROUND OF THE INVENTION

1. Field of the Invention

The present invention relates to a nursing bottle with a teat, and more particularly to the combination oh the nursing bottle with a teat detachably engaged with a rim which is screwed onto the nursing bottle. The teat together with the rim enables the baby to suck the liquid in the bottle easily and will not hinder the suction of the baby even when the passage of the teat is blocked by the lip of the baby.

2. Description of Related Art

Normally, a teat is provided for the baby to suck the liquid within the nursing bottle. In order to allow the liquid within the bottle to flow freely from the teat., a passage is defined in the teat to communicate with the air, such that the air within the bottle is able to communicate with the ambient air and by the communication between the air within the bottle and outside the bottle, the liquid is able to be sucked out of the bottle. However, because the baby does not know the importance of the communication between the air within the bottle and outside the bottle, the passage may be blocked by the vacuum created as a result of incorrect suction of the baby.

Therefore, it is an objective of the invention to provide an improved bottle with a teat to mitigate and /or obviate the aforementioned problems.

SUMMARY OF THE INVENTION

The primary objective of the invention is to provide an improved teat having a hole defined in the flange of the teat and a rim having multiple apertures defined in the skirt formed on the rim and corresponding to the hole, such that the air within the nursing bottle and outside the nursing bottle is able to be kept communication with each other at all times. Therefore, the liquid within the nursing bottle is able to be sucked out of the nursing bottle easily by the baby.

Another objective of the invention is to provide an improved nursing bottle having a teat and a rim threadingly engaged with the nursing bottle. The apertures defined in the skirt of the rim are so small that liquid within the nursing bottle will not leak out of the bottle.

Still another objective of the invention is to provide at least two annular flanges on the skirt of the rim and keep the multiple apertures defined between the two flanges, such that when the teat engaged with the rim, the apertures will not be blocked by the flanges of the teat.

Other objectives, advantages and novel features of the invention will become more apparent from the following detailed description when taken in conjunction with accompanying drawings.

DETAILED DESCRIPTION OF PREFERRED EMBODIMENT

Figure 1:
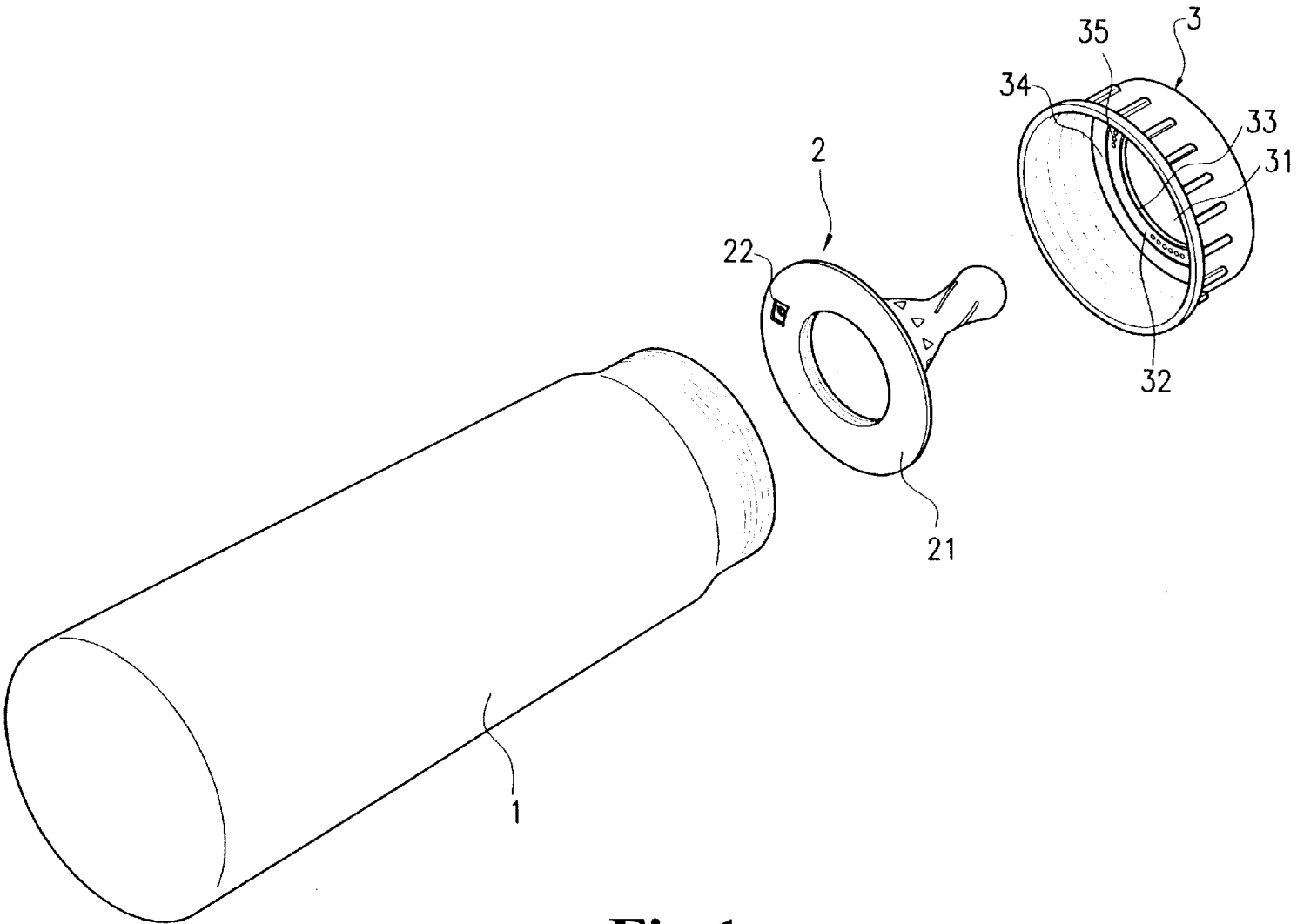
FIG. 1 is an exploded perspective view of the nursing bottle with a teat and a rim constructed in accordance with the present invention.

With reference to FIG. 1, it is to be noted that the invention has a nursing bottle 1, a teat 2 and a rim 3.

The teat 2, sandwiched between the nursing bottle 1 and the rim 3, has a first flange 21 formed to expand outwardly and a hole 22 defined in the first flange 21.

The rim 3 is threadingly engaged with the nursing bottle 1 and has a central through hole 31 defined to receive the insertion of the teat 2, a skirt 32 formed near one end thereof and engaged with the first flange 21 if the teat 2, a first annular flange 33 and second annular flange 34 formed on the skirt 32 and spaced apart from each other and a plurality of apertures 35 defined between the first and the second annular flange 33, 34 and corresponding to the hole 22 of the teat 2.

Figure 2:
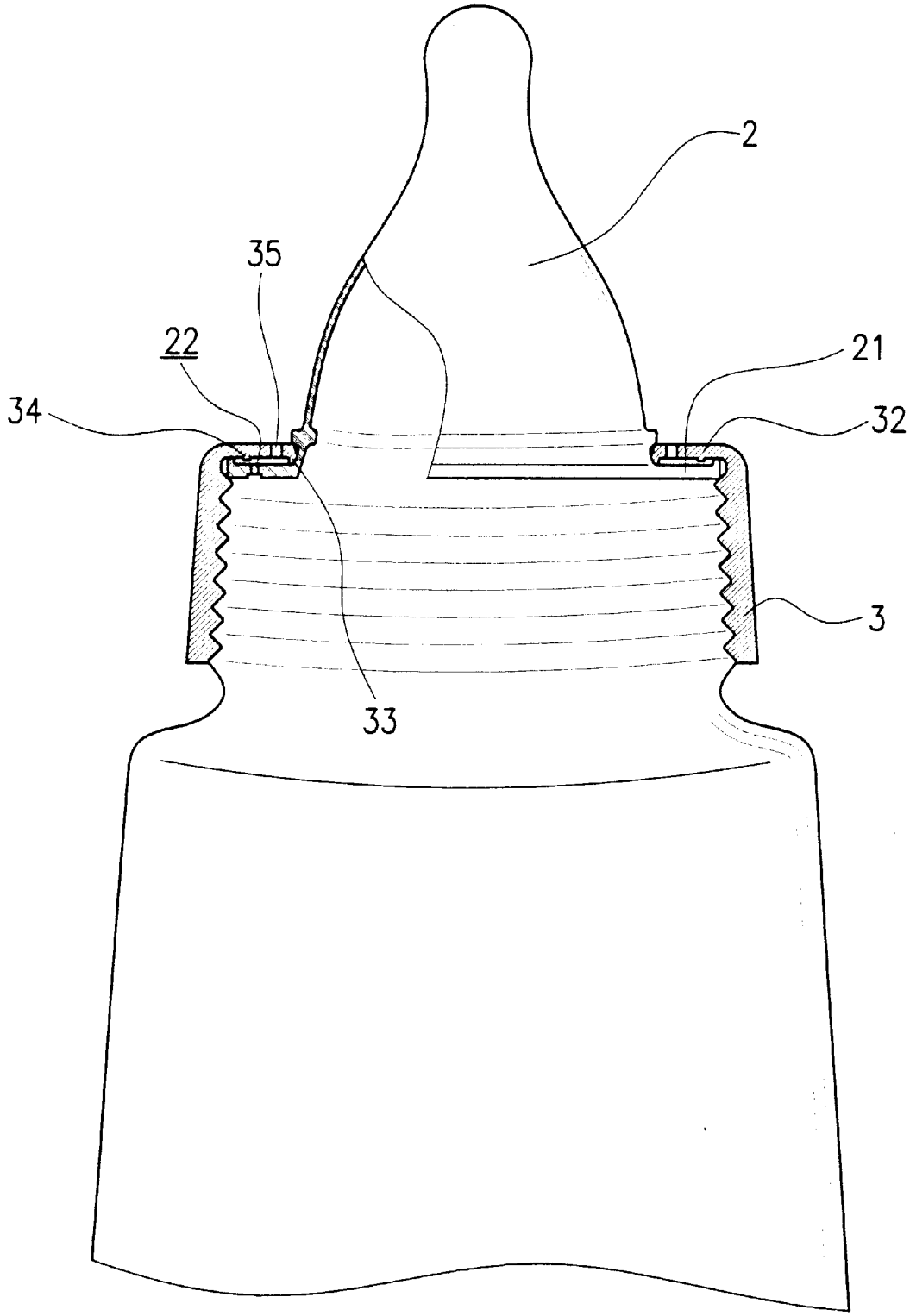
FIG. 2 is a side view in partial cross section showing the engagement of the teat, the rim and the nursing bottle of the invention.
Figure 3:
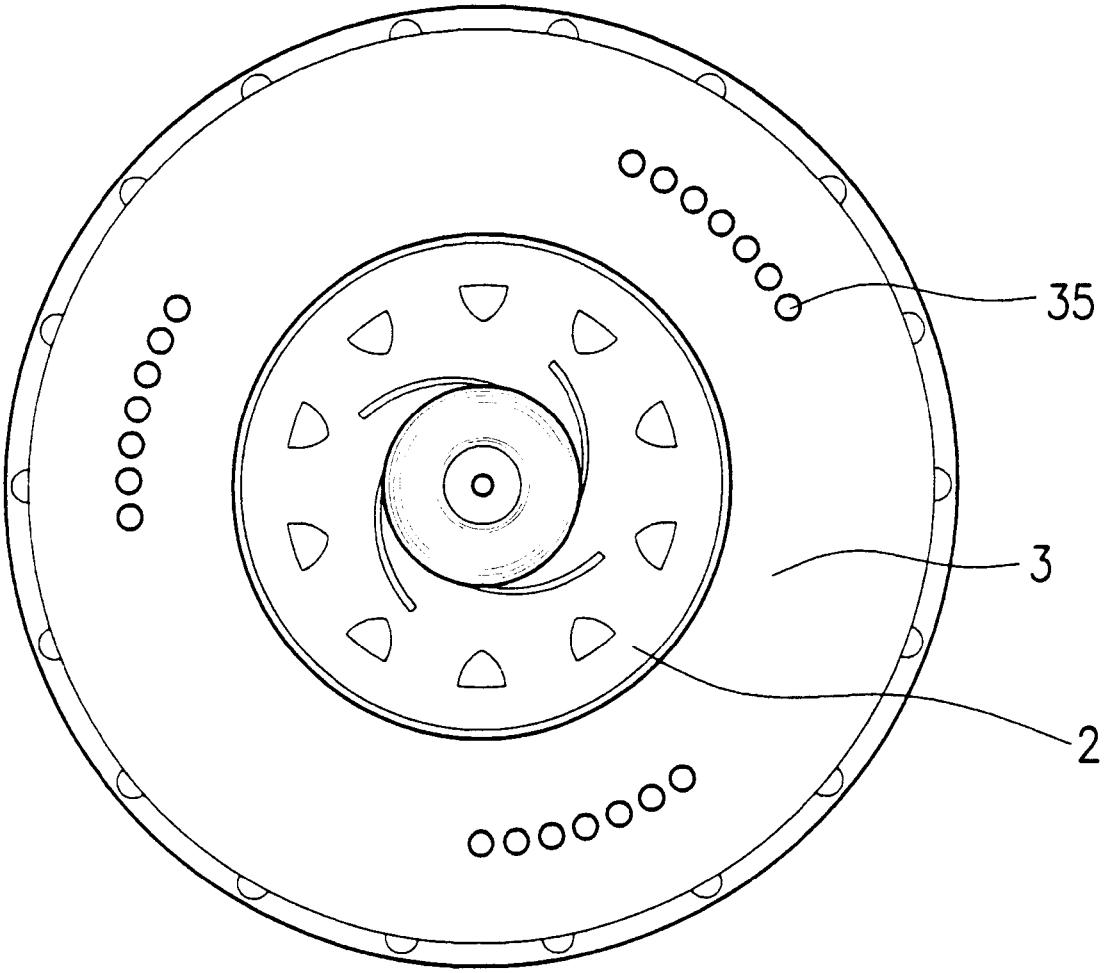
FIG. 3 is a top view of the teat and the rim combined together.

Referring to FIG. 2, when the nursing bottle 1, the teat 2 and the rim 3 are assembled, the teat 2 is first inserted into the central through hole 31 of the rim 3 with the first flange 21 abutted against the skirt 32 of the rim 3, as shown in FIG. 3. Then, the rim 3 together with the teat 2 is threadingly engaged with the nursing bottle 1. It is noted that the hole 22 in the first flange 21 correspond to the multiple apertures 35 after assembled, such that the air within the nursing bottle 1 communicates with the ambient air outside the nursing bottle 1. Therefore, when the liquid within the nursing bottle 1 is sucked out of the nursing bottle 1, the ambient air will flow through the apertures 35 and the corresponding hole 22 and into the nursing bottle 1 to fill the volume of the liquid sucked out of the nursing bottle 1, so as to keep the air communication within the nursing bottle 1 and outside the nursing bottle 1.

Figure 4:
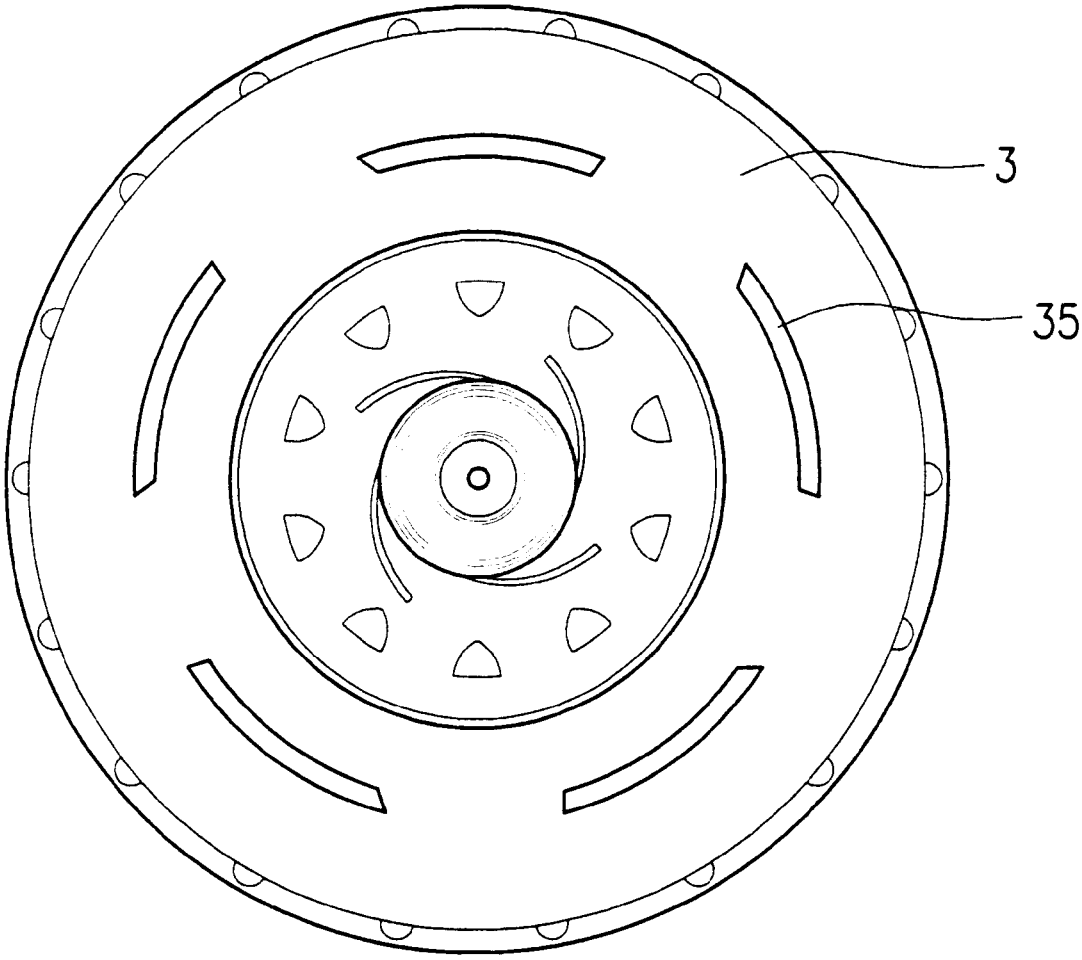
FIG. 4 is a top view showing another embodiment of the taet and the rim combined together.

Furthermore, as shown in FIG. 4, the multiple apertures 35 between the first annular flange 33 and the second annular flange 24 are now defined as elongated and arcuate slots , which can still fulfill the requirement as described earlier .

It is to be understood, however, that even through numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A nursing bottle with a teat and a rim, wherein the improvements comprises:

the teat having a first flange and a hole defined in the first flange;

the rim being threadingly engaged with the nursing bottle and having a central through hole defined to receive the insertion of the teat, a skirt formed near one end thereof and abutted against the first flange of the teat, a first annular flange and a second annular flange formed on the skirt and spaced apart from each other and a plurality of apertures defined between the first and the second annular flanges and corresponding to the hole of the teat.

* * * * *